US006448904B1

(12) United States Patent
Flores

(10) Patent No.: US 6,448,904 B1
(45) Date of Patent: Sep. 10, 2002

(54) CLEAR-CROSS CROSSING SYSTEM

(76) Inventor: James D. Flores, 9225 S. Morrill Ave., Santa Fe Springs, CA (US) 90670

( * ) Notice: Subject to any disclaimer, the term of this patent is extended or adjusted under 35 U.S.C. 154(b) by 0 days.

(21) Appl. No.: 09/790,140

(22) Filed: Feb. 21, 2001

Related U.S. Application Data

(60) Provisional application No. 60/184,383, filed on Feb. 23, 2000.

(51) Int. Cl.[7] ..... G08G 1/07

(52) U.S. Cl. ..... 340/906; 340/902; 340/904; 340/917

(58) Field of Search ..... 340/902, 906, 340/907, 910, 916, 917, 321, 473, 331

(56) References Cited

U.S. PATENT DOCUMENTS 3,895,345 A * 7/1975 Elvers et al. ..... 340/907
4,115,757 A * 9/1978 Blahunka ..... 340/906
4,408,180 A * 10/1983 Metz ..... 340/907
5,345,232 A * 9/1994 Robertson ..... 340/906
5,801,646 A * 9/1998 Pena ..... 340/902
5,973,618 A * 10/1999 Ellis ..... 340/990

* cited by examiner

*Primary Examiner*—Van Trieu
(74) *Attorney, Agent, or Firm*—Joseph N. Breaux

(57) ABSTRACT

An clear-cross crossing system for use by emergency vehicles that includes a traffic light attachable strobe light/receiver unit that is attachable to and existing traffic signal and a transmitter unit mounted to the dash board of an emergency vehicle which transmits an activation signal to the strobe light/receiver unit to activate the unit and to cause the unit to override the existing traffic signal to generate a green light signal in the direction of the oncoming emergency vehicle.

1 Claim, 2 Drawing Sheets

CLEAR-CROSS CROSSING SYSTEM

This application claims priority from provisional application Ser. No. 60/184,383, filed Feb. 23, 2000.

TECHNICAL FIELD

The present invention relates to traffic control equipment and more particularly to an electronic warning system designed to allow an emergency vehicle operator to control a traffic signal that includes a strobe light/receiver unit attached to an existing traffic signal and a transmitter mounted to the dash board in emergency vehicle which transmits an activation signal to the strobe light/receiver unit to activate the unit and to over ride the existing traffic signal to generate a green signal in the direction of the oncoming emergency vehicle.

BACKGROUND OF INVENTION

It is often necessary for emergency vehicles to navigate intersections with utmost speed to arrive at a location in a timely fashion. In order to expedite travel through the streets of a city or the like, it would be desirable to have a clear-cross crossing system which would allow an operator of an emergency vehicle to gain control of a traffic signal and to cause the traffic signal to generate a green light in the direction of the oncoming emergency vehicles so that the emergency vehicle could rapidly transit the intersection. The transmitter would include an intensity adjustment mechanism for allowing a user to adjust the frequency and intensity of the transmitter to activate the receiver/strobe light unit from varying distances.

SUMMARY OF INVENTION

It is thus an object of the invention to provide a clear-cross crossing system that includes a strobe light/receiver unit attached to an existing traffic signal, and a transmitter mounted to the dash board in an emergency vehicle which transmits an activation signal for overriding the operation of the existing traffic signal.

Accordingly, a clear-cross crossing system is provided that includes a strobe light/receiver unit attachable to an existing traffic signal controller and a transmitter mounted to the dashboard in an emergency vehicle that transmits an activation signal to the receiver unit for overriding the operation of the existing traffic signal and causing the existing traffic signal to illuminate a green light in the direction of the oncoming emergency vehicle. In a preferred embodiment, a transmitter includes a frequency and intensity adjustment knob for adjusting the frequency of the intensity of the transmitted signal.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
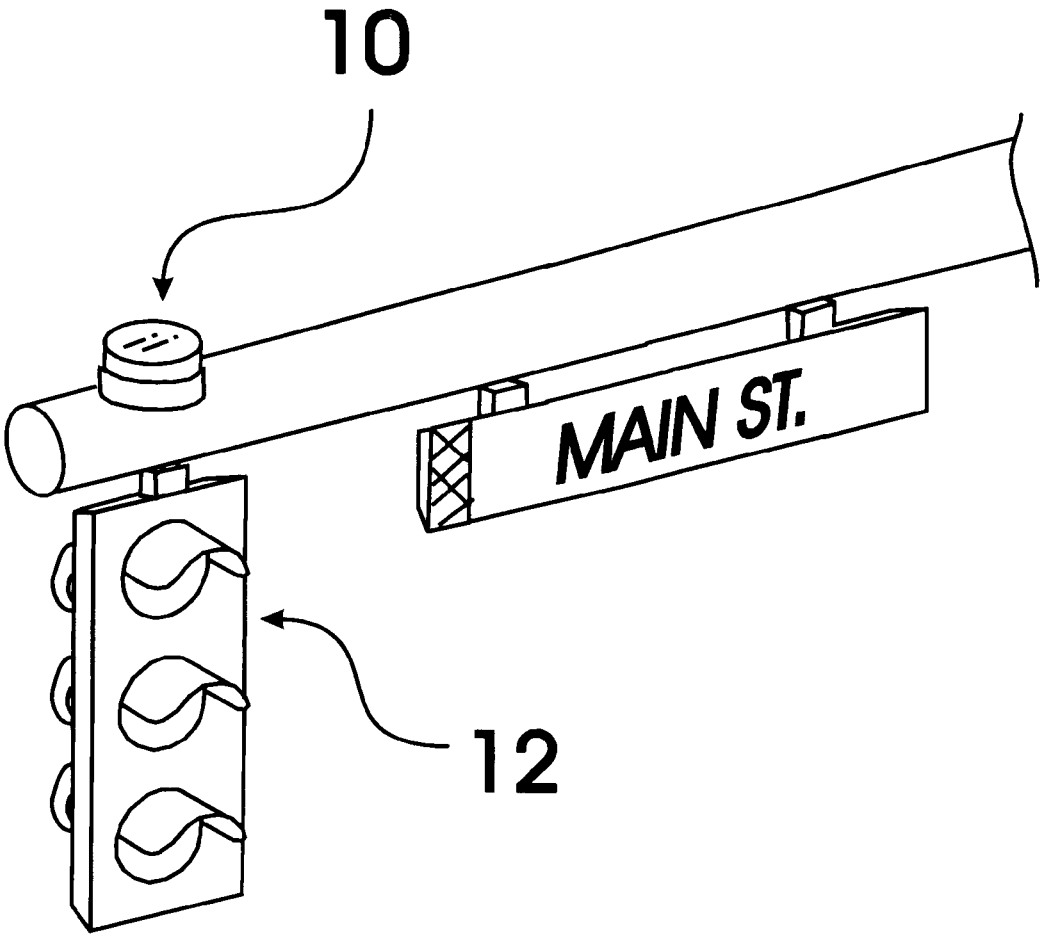
FIG. 1 shows an exemplary embodiment of the receiver/strobe light unit attached to an existing traffic light signal.
Figure 2:
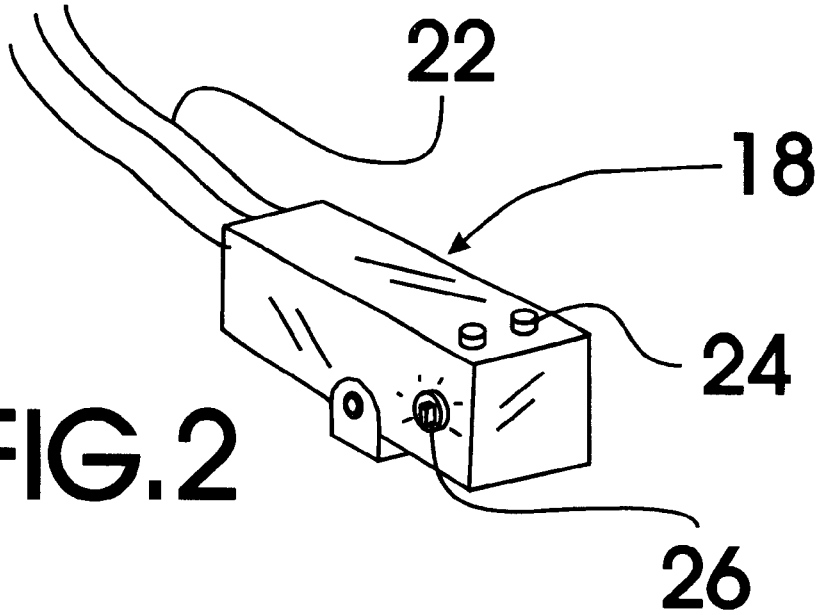
FIG. 2 shows a transmitter unit.
Figure 3:
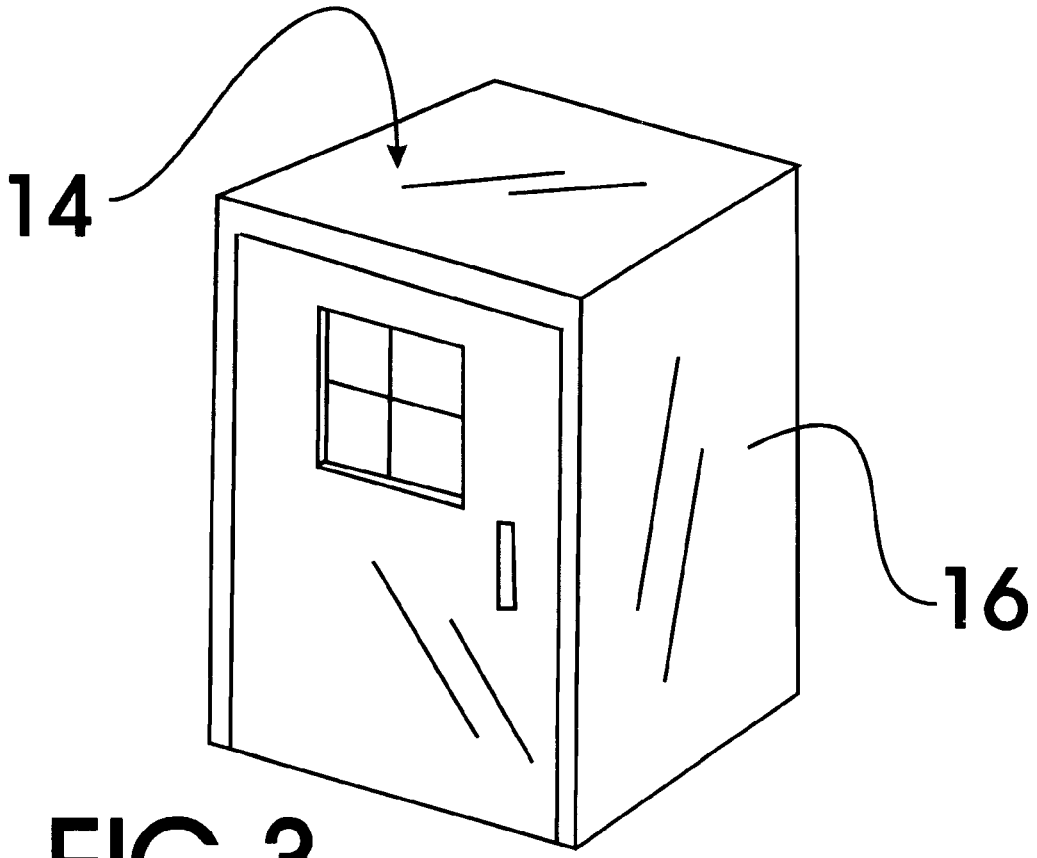
FIG. 3 shows a traffic light controller having a intersection CPU for controlling the traffic light signal of FIG. 1.

FIG. 1 shows an exemplary embodiment of the strobe light/receiver unit generally designated 10 in use on a representative traffic light system 12 that is controlled with reference to FIG. 3 by a CPU unit 14 contained within a housing 16.

A transmitter 18 is included in the system and is provided with a dash board mounting bracket 20 and which transmits an activation signal 22 from a radio transmitter provided therein which is activated by on/off button 24 and the frequency and power of which is controlled by a dial 26. In use, the emergency vehicle operator depresses the on button to send a signal to the receiver unit and take control of the intersection CPU causing the traffic light 12 to turn green in the direction of the oncoming emergency vehicle.

It can be seen from the preceding description that a clear-cross crossing system has been provided.

It is noted that the embodiment of the clear-cross crossing system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A traffic signal controller system for controlling an existing traffic signal controller; the traffic signal controller system comprising:

a strobe light/receiver unit attachable to an existing traffic signal controller; and a transmitter mounted to a dashboard in an emergency vehicle that transmits an activation signal to the receiver unit for overriding operation of the existing traffic signal controller and causing the existing traffic signal controller to illuminate a green light in the direction of an oncoming emergency vehicle;

the transmitter including a frequency and intensity adjustment knob for adjusting the frequency of the intensity of the transmitted activation signal.

* * * * *